United States Patent [19]

Lenox et al.

[11] Patent Number: 4,556,625

[45] Date of Patent: Dec. 3, 1985

[54] DEVELOPMENT OF A COLORED IMAGE ON A CELLULOSIC MATERIAL WITH MONOSULFONYL AZIDES

[75] Inventors: Ronald S. Lenox, Lancaster; Anne L. Schwartz, Columbia, both of Pa.; Charles E. Hoyle, Hattiesburg, Miss.

[73] Assignee: Armstrong World Industries, Inc., Lancaster, Pa.

[21] Appl. No.: 555,298

[22] Filed: Nov. 25, 1983

Related U.S. Application Data

[63] Continuation-in-part of Ser. No. 396,800, Jul. 9, 1982, abandoned.

[51] Int. Cl.[4] ..... G03C 5/00; G03C 5/18; D06P 1/54; D06P 1/642

[52] U.S. Cl. ..... 430/145; 430/142; 430/147; 430/194; 430/197; 430/292; 430/325; 430/337; 430/919; 430/927; 8/402; 8/444; 8/446; 8/448; 8/449; 8/478; 8/536; 8/537; 8/553; 8/554; 8/921; 260/349

[58] Field of Search ..... 430/142, 145, 149, 194, 430/197, 292, 325, 337, 919, 927; 8/444, 446, 448, 449, 478, 530, 537, 554, 921, 553, DIG. 12, 402; 260/349

[56] References Cited

U.S. PATENT DOCUMENTS

| | | | |
|---|---|---|---|
| 1,926,322 | 9/1933 | Van der Grinten | 430/147 |
| 2,861,863 | 11/1958 | Schuster et al. | 8/553 |
| 3,227,510 | 1/1966 | Bridgeford | 8/553 |
| 3,282,693 | 11/1966 | Sagura et al. | 430/147 |
| 3,462,268 | 8/1969 | Danhauser et al. | 260/349 |
| 3,467,518 | 9/1969 | Laridon et al. | 430/306 |
| 3,630,735 | 12/1971 | Itano et al. | 430/337 |
| 4,243,390 | 1/1981 | Schafer et al. | 8/553 |
| 4,287,294 | 9/1981 | Rubner et al. | 430/919 |
| 4,322,211 | 3/1982 | Hoyle et al. | 8/402 |
| 4,451,551 | 5/1984 | Kataoka et al. | 430/197 |

*Primary Examiner*—Charles L. Bowers, Jr.

[57] ABSTRACT

The present invention discloses a method of photolytically developing a colored image on a cellulosic material. In this method, the material is contacted with a nitrogen containing polymer in solution and a mono-sulfonyl azide compound in solution. The sample is thereafter exposed to a UV-containing light source for an amount of time sufficient to develop a color thereon.

15 Claims, No Drawings

DEVELOPMENT OF A COLORED IMAGE ON A CELLULOSIC MATERIAL WITH MONOSULFONYL AZIDES

CROSS REFERENCE TO RELATED APPLICATION

This application is a continuation-in-part of U.S. Application Ser. No. 396,800, filed July 9, 1982, abandoned, in the names of Ronald S. Lenox et al., entitled "Development of a Colored Image on a Cellulosic Material with Sulfonyl Azides.

BACKGROUND OF THE INVENTION

Several examples of the photolysis of polymers with di, tri or other polyfunctional azide crosslinking agents are shown in the art. For example, Laridon et al., U.S. Pat. No. 3,467,518, described one formation of a resist image by the photochemical crosslinking of polymers carrying groups which are reactive with intermediates derived from the photochemical decomposition of a compound containing at least two azidosulfonyl groups. Such crosslinking is believed to occur because of the formation and subsequent reaction of a disulfonylnitrene intermediate which presumably serves as the crosslinking agent.

In view of such art, it would not be expected that any product resulting from the photolysis of a solvent soluble polymer and a mono-sulfonyl azide would be made solvent insoluble after photolysis. However, it has now been unexpectedly found that a mixture of a nitrogen containing polymer with a mono-sulfonyl azide will become solvent insoluble after exposure to a UV-containing light source. Moreover, such insolubilized areas quite unexpectedly develop a variety of colors which are extremely stable and which do not appreciably change with time if the photolysis is carried out on a cellulosic material.

DESCRIPTION OF THE INVENTION

The invention contemplates a method of photolytically developing a colored image on a cellulosic material. The method of the invention comprises first pretreating the material by contacting its surface with at least one mono-sulfonyl azide compound in solution and at least one nitrogen containing polymer in solution. After this pretreatment step, the material is exposed to a UV-containing light source, whereupon a color photolytically develops on the material. While color may be developed photolytically by the monosulfonyl azides alone, such colors are not washfast and are easily extracted by solvents.

The mono-sulfonyl azides suitable for use in the present invention will have the general formula $$R—SO_2N_3$$

wherein R is an aliphatic, aryl aliphatic or aryl radical containing from 1 to about 25, and preferably from 2 to about 15, and most preferably from 4 to about 12 carbon atoms. In addition to the sulfonyl azide groups, R may be further substituted by halogen, amine, substituted amine, $C_1$–$C_5$—alkoxy, ether groups, alcohol groups, acid and functionalyzed acid groups, ketone and aldehyde groups, nitro groups and/or amido groups and derivatives thereof.

The term "aliphatic" is used herein in its art recognized sense. Examples of suitable aliphatic radicals, which may or may not be substituted with the groups set forth above, include alkyl (paraffin) groups, alkenyl groups that have either 1 or 2 double carbon-carbon bonds and alkynes which contain one triple carbon-carbon bond and their cyclic analogs. The most preferred aliphatic radicals are butyl, pentyl, hexyl, heptyl, octyl, nonyl, decyl, undecyl and dodecyl.

The term "aryl" is used herein in its art recognized sense to signify an aromatic hydrocarbon group (that may or may not be substituted), that contains one less hydrogen that the parent arene, which is benzene, a benzene derivative, or a compound that resembles benzene in chemical behavior. Examples of suitable aryl radicals include phenyl, naphthyl, anthracenyl, naphthacenyl and phenanthrenyl.

Examples of suitable aryl aliphatic radicals include benzyl, tolyl, mesityl, xylyl, cinnamyl, phenethyl, styryl and trityl.

Exemplary mono-sulfonyl azides suitable for use in the present invention include benzenesulfonyl azide; p-acetamidobenzenesulfonyl azide; p-methoxybenzenesulfonyl azide; p-toulenesulfonyl azide; p-nitro benzenesulfonyl azide; 4-oxo-4-(4-sulfonylazidophenylamino) butanoic acid and the corresponding methyl ester; benzenesulfonyl azide.

The nitrogen-containing polymers that are useful in the present invention are those that have Lewis base properties and contain nitrogen in a form in which the nitrogen is covalently attached to carbon or hydrogen atoms only. Thus, polymers that contain carbazole, pyridine, pyrrole, or similar ring systems are useful as are polymers which contain suitable nitrogen groups. Specific examples of useful polymers include, but are not limited to, poly(N-vinylcarbazole), poly(2-aminostyrene), poly(2-vinylpyridine), and poly(4-vinylpyridine).

The term "nitrogen-containing polymer" is used herein to indicate either polymers or copolymers wherein at least one of the original monomers contains a nitrogen function as described above.

Generally, the washfastness and non-extractability of the colors by solvent developed by the method of the present invention will increase in direct proportion to the amount of nitrogen present in the nitrogen-containing polymer. However, copolymers that contain as little as about 1% of a nitrogen-containing monomer are suitable for use in the method of the present invention.

Solvents that will dissolve the sulfonyl azide compound and/or the nitrogen-containing polymer are suitable for use in the present invention. Such solvents should be sufficiently volatile so that they will eventually evaporate from the surface of the substrate being treated by the process of the present invention. If the substrate being treated is wood, the solvent used should not be capable, during the duration of the treatment time, of substantially swelling the wood's grain.

Exampes of suitable solvents include but are not limited to tetrahydrofuran (THF), 1,4-dioxane, and dimethylformamide (DMF).

There will preferably be at least 0.001 g of sulfonyl azide compound and at least 0.001 g of polymer for every 100 ml (deciliter) of solvent. Theoretically, concentrations of sulfonyl azide and nitrogen-containing polymer lower than 0.001 g/100 ml solvent may be utilized to acheive a coloration effect. However, at such low concentration, repeated applications of the solution(s) to the cellulosic material may be required in order to have adequate color development.

The upper concentrations of mono-sulfonyl azide and copolymer are only limited by the amount of azide and polymer that can be put into solution. Normally, more mono-sulfonyl azide and polymer can be put into solution if the temperature of the solution(s) increases or if the solution(s) is put under pressure. With all other factors being identical, it has been discovered that higher azide concentrations in the solution will produce darker colors on the cellulose material than lower azide concentrations.

The azide and polymer solutions may be applied to the cellulose material in any order that is convenient to the individual practitioner of the invention. Alternatively, a solution containing both the azide and the polymer in an appropriate solvent(s) may be applied to the cellulose material. The term "solution(s)," as used herein, is understood to mean both the azide and polymer solution or one solution containing at least one azide compound and at least one polymer in an appropriate solvent(s).

Likewise, the phrases "a nitrogen-containing polymer in solution and a sulfonyl azide compound in solution" and "a solution of a nitrogen-containing polymer and a solution of a sulfonyl azide compound" are interchangeably used herein to refer to either separate solutions that contain therein, respectively, a nitrogen-containing polymer and a sulfonyl azide compound or one solution that contains therein both a nitrogen containing polymer and a mono-sulfonyl azide compound. In any event, the solution(s) thus applied should be allowed to dry prior to being exposed to the UV-containing light source in order to facilitate handling and prevent solvent vapor from building up during photolysis. Once dried, the cellulose material may be stored in the dark for several months without development of color.

The cellulosic material may be contacted with the sulfonyl azide/polymer solution(s) in any manner that is convenient to the individual practitioner of the invention. For example, the material may be completely or partially immersed in the solution(s) or the solutions(s) may be sprayed or brushed on the sample. The solution(s) may be applied to all or a portion of the material. For example, the solution may be applied so as to produce a decorative pattern on one or more surfaces of the material. For instance, the material may be patterned by placing a decorative mask over a surface of the material, treating the exposed portions of the surface with the solution, removing the mask and exposing the surface to the UV-containing light. Alternatively, a surface can be completely treated with the solution of the present invention. Selected areas of the surface can then be exposed to UV light, for instance by exposure through a mask or film positive or negative to thereby create the desired patterned effect.

After being contacted with the solution(s), the material may optionally be water washed and, if desired, dried. The material is then exposed to a UV-containing light source for an amount of time sufficient to develop color on the material.

It is understood that the practitioner of this invention can vary the color developed by varying selected factors such as the concentration of the azide and/or the polymer in the solution, the treatment contact time, the temperature of the solution, the specific azide and/or polymer being used, the UV exposure time and the wavelength of the UV light.

With regard to the polymer being used, it is understood that nitrogen-containing polymers cannot, by themselves, be used to pholytically develop color on a cellolosic material. However, these polymers, when used in conjunction with a sulfonyl azide compound, can influence what specific color will be developed. It has been discovered that such polymers will, for instance, serve to increase the sensitivity of sulfonyl azide compounds to lower wavelength UV light.

It has been discovered that the color developed on the cellulosic material will be dependent to some degree on the wavelength of the UV-light to which it has been exposed. Generally, shorter wavelength UV light will produce a darker color on the treated cellulosic material than longer wavelength UV light. Thus, it is possible to achieve a differential color effect on a cellulosic material if the material is exposed, in a patterned fashion, to different UV-wavelengths.

The duration of the UV-light exposure will also have a bearing on the color that is developed on the cellulosic material. Generally, longer exposure times will produce a darker color on the cellulosic material.

Any source of UV light, including sunlight, can photolytically produce color development, however slight, on a treated cellulosic material. This is significant in those situations where an entire surface of a cellulosic material is treated and then selectively exposed, such as through a mask or a film positive or negative to UV radiation. Those areas that were not exposed may ultimately develop an undesired color, even if they are only exposed to room light. It has been discovered that unexposed areas of a treated material can be prevented from turning color by further treating such areas or the entire surface with any olefin such as, but not limited to, dicyclopentadiene, dipentene, 1-hexene, 1-decene and diisobutylene which would react with the unreacted azides. In order to facilitate the reaction between the azides and the olefins, it is preferred that the material be contacted with hot olefins, i.e. olefins that are heated either neat or in solution at temperatures ranging from 50° C. to 200° C. In addition, aqueous or alcohol solutions of reducing reagents such as $NaBH_4$ and $Na_2S_2O_4$ can be used to treat unexposed areas in an analogous fashion to produce similar results.

A commercially available mixture of olefins that we have found particularly useful is turpentine, which consists mainly of alpha and beta pinene. When used on treated wood, the odor is pleasant and any residual turpentine on the wood is easily removed by evaporation and/or petroleum spirits.

The process of the present invention is suitable for developing a color on cellulosic material such as, for example, paper, wood, flakeboard and any material made from paper fibers and/or wood products.

For example, the process may be utilized on wood for the preparation of decorative images on veneered panels suitable for door panels, drawer fronts and other furniture parts or on paper packaging materials.

EXAMPLES

In Examples 1–21, solutions were prepared of 0.25 g of a specified azide compound in 10 ml of THF and 0.8 g of a nitrogen-containing polymer in 100 ml dichloromethane. Approximately five drops of a polymer solution were then applied to white filter paper. After the solvent evaporated, approximately 5 drops of an azide solution were applied to the same paper. The papers that were impregnated with the azide/polymer solutions were then irradiated under two separate conditions: for one minute under the full output of a medium pressure mercury lamp and for three minutes under the long wavelength (366 mm) "black light" produced by a commercially available fluorescent-type bulb. Any colors developed on the papers were then noted. An attempt was then made to extract the colors by separately boiling the papers for 10 minutes in water, acetone and ethanol. Those colors which are not extractable are able to be overcoated with varnishes, lacquers or other typical coatings without dissolution or degradation of the image. If desired, such a coating may contain a UV screening compound such as Tinuvin P as supplied by the Geigy Chemical Corporation to provide additional protection for both the imaged and non-imaged areas of the product. It should be noted that if color is developed by photolysis of the azide by itself in the absence of the nitrogen-containing polymer or in the presence of a low molecular weight nitrogen-containing compound, such colors will not survive overcoating with lacquers or varnishes nor will they adequately survive treatment with the compounds used to destroy azide in the non-imaged, i.e., non-exposed, areas.

Poly(vinylpyridine), which was utilized in Examples 15–21, and poly(N-vinylcarbazole), which was utilized in Examples 1–7 and 22–27, were obtained commercially. The partially aminated polystyrene utilized in Examples 8–14 was synthesized as follows: Polystyrene of molecular weight 16,000 (gpc) was first prepared by polymerizing styrene with AIBN in refluxing toluene. The polymer was purified by dissolving it in benzene and precipitating with methanol and was then dried at 50° C. under high vacuum. Twenty grams of the thus prepared polymer was dissolved in 200 ml of carbon tetrachloride. 30 ml of acetic anhydride was added to the solution. The temperature of the solution was lowered to 10° C. and 10 ml of concentrated $HNO_3$ was slowly added. After the temperature had returned to 10° C., the reaction was poured into 1400 ml of methanol. The partially nitrated polymer was collected and dried. Infrared analysis showed the presence of the $—NO_2$ group (1360, 1520 $cm^{-1}$). In a three-necked flask fitted with an open condenser, a thermometer and a nitrogen inlet, was placed 25 ml of pure phenylhydrazine. This was heated to 200° C. and 1 g of the above nitrated material was slowly added. Heating at 200° C. was continued for one hour. The reaction was then cooled and poured into 200 ml of cold ether. The light brown polymeric product was collected, washed in ether and dried. The IR spectrum showed no evidence of nitro groups. This material was then used in Examples 8–14.

The data from Examples 1–21 are set forth in TABLE I.

TABLE I

| | | | Color Developed After Exposure to | | Amount of Color Extracted in Boiling | | |
|---|---|---|---|---|---|---|---|
| Example | Azide | Polymer | Full Arc (FA) | 366 mm (366) | Water | Acetone | Ethanol |
| 1 | p-Methoxybenzenesulfonyl azide | Poly(N—vinylcarbazole) | Dark Brown | Light Brown | None (FA) None (366) | None (FA) None (366) | None (FA) None (366) |
| 2 | Benzenesulfonyl azide | Poly(N—vinylcarbazole) | Dark Brown | Light Brown | None (FA) None (366) | None (FA) None (366) | None (FA) None (366) |
| 3 | 4-Oxo-4(4-sulfonylazido-phenylamino)butanoic acid | Poly(N—vinylcarbazole) | Tan | Tan | None (FA) None (366) | None (FA) | None (FA) |
| 4 | Methyl-4-oxo-4-(4-sulfonyl-azidophenylamino)butanoate | Poly(N—vinylcarbazole) | Brown | Tan | None (FA) None (366) | None (FA) | None (FA) |
| 5 | p-Acetamidobenzenesulfonyl azide | Poly(N—vinylcarbazole) | Brown | Light Brown | None (FA) None (366) | None (FA) None (366) | None (FA) None (366) |
| 6 | p-Nitrobenzenesulfonyl azide | Poly(N—vinylcarbazole) | Brown | Cream | None (FA) Half (366) | None (FA) Half (366) | None (FA) Half (366) |
| 7 | p-Toluenesulfonyl azide | Poly(N—vinylcarbazole) | Light Brown | Tan | None (FA) None (366) | None (FA) None (366) | None (FA) None (366) |
| 8 | p-Methoxybenzenesulfonyl azide | Partially Aminated Polystyrene | Orange | None | Half | Half | All |
| 9 | Benzenesulfonyl azide | Partially Aminated Polystyrene | Yellow | None | None | None | None |
| 10 | 4-Oxo-4(4-sulfonylazido-phenylamino) butanoic acid | Partially Aminated Polystyrene | Light Brown | Cream | None(1) | Half | All |
| 11 | Methyl 4-oxo-4-(4-sulfonyl-azidophenylamino) butanoate | Partially Aminated Polystyrene | Light | None | Half(1) | Most | All |
| 12 | p-Acetamidobenzenesulfonyl azide | Partially Aminated Polystyrene | Light Brown | Cream | Most(1) | Most | Most |
| 13 | p-Nitrobenzenesulfonyl azide | Partially Aminated Polystyrene | Yellow | Cream | None(1) | Most | None |
| 14 | p-Toluenesulfonyl azide | Partially Aminated Polystyrene | Yellow | None | None | Half | Most |
| 15 | p-Methoxybenzenesulfonyl azide | Poly(2-vinylpyridine) | Orange | None | None | None | None |
| 16 | Benzenesulfonyl azide | Poly(2-vinylpyridine) | Cream | None | None | None | None |
| 17 | 4-Oxo-4-(4-sulfonylazido-phenylamino)butanoic acid | Poly(2-vinylpyridine) | Light Brown | None | None | None | None |
| 18 | Methyl 4-oxo-4-(4-sulfonyl-azidophenylamino) butanoate | Poly(2-vinylpyridine) | Light Brown | None | Slight | None | All |
| 19 | p-Acetamidobenzenesulfonyl azide | Poly(2-vinylpyridine) | Light Brown | None | Most | None | All |
| 20 | p-Nitrobenzenesulfonyl azide | Poly(2-vinylpyridine) | Brown | Light | None(1) | None | Half |
| 21 | p-Toluenesulfonyl azide | Poly(2-vinylpyridine) | Yellow | None | None | Most | All |

(1)Color extraction tests were made only with those colors developed by full arc exposure

COMPARATIVE EXAMPLES 1–7

In these comparative examples, solutions were prepared of 0.25 g of a specified azide compound (selected from the azide compounds utilized in Examples 1–7) in 10 ml of THF. Approximately 5 drops of an azide solution were applied to white filter paper. The paper was then irradiated under the same conditions utilized for the examples above, and any colors developed were noted. An attempt was then made to extract the colors developed by the full arc exposure by boiling the papers for 10 minutes in water, acetone and ethanol. The data from these comparative examples are set forth in Table II.

TABLE II

| Comparative Example | Azide of Example | Color Developed After Exposure to Full Arc | Color Developed After Exposure to 366 mm | Amount of Color Extracted in Boiling Water | Amount of Color Extracted in Boiling Acetone | Amount of Color Extracted in Boiling Ethanol |
|---|---|---|---|---|---|---|
| 1 | 1 | Orange | None | All | All | All |
| 2 | 2 | Yellow | None | All | Most | All |
| 3 | 3 | Yellow | None | All | Most | All |
| 4 | 4 | Yellow | None | All | Half | All |
| 5 | 5 | Cream | None | None | All | Most |
| 6 | 6 | Yellow | None | All | Most | All |
| 7 | 7 | Yellow | None | All | Most | All |

The above data clearly indicates that the paper treated with the azide solutions only and subsequently irradiated will develop colors that are extractable by solvents.

Examples 22–25 demonstrate the utility of the process of the present invention for preparing decorative wood panels.

EXAMPLE 22

A birch veneer plywood board, which measured 24"×18", was treated by brush application with a solution that contained 2.0 g of p-methoxybenzenesulfonyl azide and 2.0 of poly(N-vinylcarbazole) in 100 ml of THF. Cutouts of black plastic were placed on the surface of the plywood and the sample was photolyzed under a 5000 watt medium pressure lamp for 5 minutes, until a brown color was developed on the exposed wood. The wood sample was then treated in hot (90°–120° C.) turpentine for 90 seconds, rinsed with mineral spirits and dried. The unphotolyzed areas retained their original light color, even after continued exposure to sun and room light.

EXAMPLE 23

The procedure of Example 37 was substantially repeated, except that the treatment solution contained 2.0 g of benzenesulfonyl azide and 1.5 g of poly(N-vinylcarbazole in 100 ml of THF and the sample was photolyzed for 10 minutes through a film positive. A brown color developed on the wood underneath the transparent areas of the film positive.

EXAMPLE 24

A 12"×18" pecan veneer composition board, treated according to the procedure of Example 37, was photolyzed for 5 minutes. A brown color developed on the exposed wood.

EXAMPLE 25

This example illustrates a method of achieving a two-tone effect. A pine plywood measuring 4"×4" was treated by brush application with a solution consisting of 2.0 g of para-toluenesulfonyl azide and 2.0 g of poly(N-vinylcarbazole) in 100 ml of THF. A mask was placed over the wood in such a way that a dark walnut-colored V-shaped image was formed on the wood during a three-minute exposure to a medium pressure mercury lamp. A larger V-shaped mask was then centered over the dark image on the wood and the sample exposed to 350 nm UV radiation for three minutes. This resulted in a dark image surrounded by a lighter image.

EXAMPLE 26

A piece of Whatman filter paper was impregnated by repeated application of a solution of poly(N-vinylcarbazole) and p-Methoxybenzenesulfonyl azide. When dry, the paper was exposed to the full output of a medium pressure mercury lamp through a V-shaped mask until a dark brown color developed in the exposed area. The paper was then immersed for 90 seconds in a 50° C. solution made from 2.5 g of $NaBH_4$ dissolved in 50 ml isopropanol and 50 ml ethanol. The paper was rinsed in water and dried. When placed under the lamp for a secod time, the white background did not turn brown but remained almost white.

EXAMPLE 27

A piece of filter paper treated as described in Example 41 was immersed for 3 minutes in a 50° C. solution made by dissolving 5.0 g of $Na_2S_2O_4$ (sodium hydrosulfite) in 100 ml of aqueous 0.2M sodium hydroxide solution. After three minutes at 50° C., the paper was rinsed and dried. When placed under the medium pressure mercury lamp the unexposed areas developed only a very faint color.

We claim:

1. A method of photolytically coloring a cellulosic material by contacting a surface thereof with a solution of poly(N-vinylcarbazole) and a solution of at least one monosulfonyl azide compound of the formula $$R—SO_2N_3$$

wherein R is an aliphatic, aryl aliphatic or aryl radical which contains from 1 to about 25 carbon atoms, to thereby form an admixture on the treated surface of the material, and exposing the treated material to a UV-containing light source to thereby render the admixture solvent insoluble and to photolytically develop a color on the material.

2. The method of claim 1 wherein R contains from 2 to about 15 carbon atoms.

3. The method of claim 1 wherein R contains from 4 to 12 carbon atoms.

4. The method of claim 1 wherein R is an aryl radical.

5. The method of claim 1 wherein R is an aliphatic radical.

6. The method of claim 1 wherein the poly(N-vinylcarbazole) and the azide compound are together in solution in at least one solvent for the poly(N-vinylcarbazole) and the azide compound.

7. The method of claim 6 wherein the solution contains at least 0.001 grams of the azide compound per deciliter of solvent.

8. The method of claim 6 wherein the solution contains at least 0.001 grams of the poly(N-vinylcarbazole) per deciliter of solvent.

9. The method of claim 1 wherein the treated surface is selectively exposed through a mask to the UV containing light source so that the surface will have exposed and unexposed areas.

10. The method of claim 9 wherein the unexposed areas are contacted with at least one olefin that is heated at temperatures ranging from 50° C. to 200° C.

11. The method of claim 10 wherein at least one olefin is selected from the group consisting of dicyclopentadiene, dipentene, 1-hexene, 1-decene and diisobutylene.

12. The method of claim 9 wherein the unexposed areas are contacted with turpentine that is heated at temperatures ranging from 50° C. to 200° C.

13. The method of claim 9 wherein the unexposed areas are contacted with an aqueous or alcohol solution of a reducing agent.

14. The method of claim 13 wherein the reducing agent is $NaBH_4$.

15. The method of claim 13 wherein the reducing agent is $Na_2S_2O_4$.

* * * * *